US012714243B2

(12) United States Patent
Austin, III et al.

(10) Patent No.: US 12,714,243 B2
(45) **Date of Patent: *Aug. 25, 2026**

(54) SHOWER DOOR ASSEMBLY DISPLAY

(71) Applicant: LIBERTY HARDWARE MFG. CORP., Wintson-Salem, NC (US)

(72) Inventors: James Allen Austin, III, High Point, NC (US); Matthew Klein, Apex, NC (US); Patrick Boehnen, Summerfield, NC (US); Laura Hawkins, Madison, NC (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/922,585

(22) Filed: Oct. 22, 2024

(65) Prior Publication Data

US 2025/0113930 A1 Apr. 10, 2025

Related U.S. Application Data

(60) Continuation of application No. 17/344,050, filed on Jun. 10, 2021, now Pat. No. 12,144,441, which is a (Continued)

(51) Int. Cl.
*A47F 7/00* (2006.01)

(52) U.S. Cl.
CPC ..... *A47F 7/0042* (2013.01); *Y10T 29/49826* (2015.01)

(58) Field of Classification Search
CPC ..... A47F 7/00; A47F 7/0042; A47F 7/0014; A47F 7/163; Y10T 29/49826
See application file for complete search history.

(56) References Cited

U.S. PATENT DOCUMENTS 475,948 A 5/1892 Pease
739,027 A 9/1903 Raum
(Continued)

FOREIGN PATENT DOCUMENTS

BR PI0706512 A2 3/2011
CA 2505163 A1 10/2006
(Continued)

OTHER PUBLICATIONS

CRL, "Installation Instructions CRL Deluxe Serenity Series SER95 Sliding Door Kit", Dec. 14, 2019, 11 pages.
(Continued)

*Primary Examiner* — Stanton L Krycinski
(74) *Attorney, Agent, or Firm* — Brooks Kushman P.C.; Jeffrey Doyle

(57) ABSTRACT

A retail shower door display assembly is provided with a point-of-sale display unit sized to be received within a retail store aisle. A first array of shower door glass panes is oriented within the display unit. Each shower door glass pane of the first array has a height, a thickness and a width. A second array of shower door glass panes is oriented within the display unit. Each shower door glass pane of the second array has a height, a thickness and a width that is different than the width of the first array of shower door glass panes. An array of shower door tracks is oriented within the display unit. Each shower door track of the array has a common length. An array of towel bars is oriented within the display unit. Each towel bar of the array has a common length.

15 Claims, 4 Drawing Sheets

Related U.S. Application Data division of application No. 16/058,244, filed on Aug. 8, 2018, now Pat. No. 11,058,237, and a division of application No. 15/950,400, filed on Apr. 11, 2018, now Pat. No. 11,089,887, said application No. 16/058,244 is a division of application No. 14/167,230, filed on Jan. 29, 2014, now Pat. No. 10,070,739, said application No. 15/950,400 is a continuation of application No. 14/167,230, filed on Jan. 29, 2014, now Pat. No. 10,070,739.

(56) References Cited

U.S. PATENT DOCUMENTS

| | | | |
|---|---|---|---|
| 805,570 | A | 11/1905 | Maldaner |
| 865,465 | A | 9/1907 | Williams |
| 949,915 | A | 2/1910 | Schreiber |
| 965,099 | A | 7/1910 | Forgy |
| 1,242,872 | A | 10/1917 | Saunders |
| 1,530,211 | A | 3/1925 | Siemnash |
| 1,675,147 | A | 6/1928 | Walter |
| 1,676,304 | A | 7/1928 | Walter |
| 1,688,255 | A | 10/1928 | Wasch |
| 1,714,692 | A | 5/1929 | Pagel et al. |
| 1,736,828 | A | 11/1929 | Lobban |
| 1,841,620 | A | 1/1932 | McCoy |
| 1,924,823 | A | 8/1933 | Willi |
| 1,927,837 | A | 9/1933 | Kingdon |
| 1,945,792 | A | 2/1934 | Stephens |
| 1,998,486 | A | 4/1935 | Brown |
| 2,113,288 | A | 4/1938 | Berger |
| 2,126,106 | A | 8/1938 | Goldberg |
| 2,195,577 | A | 4/1940 | Miles |
| 2,223,770 | A | 12/1940 | Nagle |
| D129,731 | S | 9/1941 | Luttrell |
| 2,290,104 | A | 7/1942 | Larson |
| 2,501,609 | A | 3/1950 | Midouhas |
| D165,358 | S | 12/1951 | Baldwin |
| D174,553 | S | 4/1955 | Harris |
| 2,757,854 | A | 8/1956 | Wall |
| 2,758,778 | A | 8/1956 | Arneson |
| 2,879,899 | A | 3/1959 | Shenkin |
| 2,884,136 | A | 4/1959 | Leighton |
| 2,887,219 | A | 5/1959 | Lester, Jr. |
| 2,937,743 | A | 5/1960 | Buttery et al. |
| 2,944,679 | A | 7/1960 | Rubenstein |
| 2,950,001 | A | 8/1960 | Bucko |
| 3,033,356 | A | 5/1962 | Meyerson |
| 3,033,357 | A | 5/1962 | Vogel |
| 3,076,222 | A | 2/1963 | Sloan |
| 3,095,970 | A | 7/1963 | Gaulke |
| 3,108,657 | A | 10/1963 | Carlson |
| 3,121,511 | A | 2/1964 | Whitehead |
| 3,140,814 | A | 7/1964 | Ellis |
| 3,144,196 | A | 8/1964 | Sindars |
| 3,175,694 | A | 3/1965 | Reibold et al. |
| D201,318 | S | 6/1965 | Tamarin |
| D202,485 | S | 10/1965 | Fletcher |
| 3,233,753 | A | 2/1966 | Rich |
| 3,347,357 | A | 10/1967 | De Soto et al. |
| 3,359,573 | A | 12/1967 | Casebolt |
| 3,361,330 | A | 1/1968 | Arneson |
| 3,385,451 | A | 5/1968 | Anderson |
| D211,321 | S | 6/1968 | Ullmann |
| 3,388,787 | A | 6/1968 | Growney |
| 3,403,777 | A | 10/1968 | Bucko |
| 3,468,593 | A | 9/1969 | Catlett |
| 3,517,459 | A | 6/1970 | Schupper |
| 3,517,801 | A | 6/1970 | Cote |
| 3,602,367 | A | 8/1971 | Nathan et al. |
| 3,636,588 | A | 1/1972 | Ferris |
| D224,692 | S | 8/1972 | Gray |
| 3,695,421 | A | 10/1972 | Wood |
| 3,732,633 | A | 5/1973 | Margolis et al. |
| D227,351 | S | 6/1973 | Winton |
| 3,777,883 | A | 12/1973 | Hackenberg |
| 3,777,896 | A | 12/1973 | Ehrilich |
| 3,889,813 | A | 6/1975 | Wright |
| 3,935,949 | A | 2/1976 | Cohen |
| D240,503 | S | 7/1976 | Crescenzi et al. |
| 4,105,125 | A | 8/1978 | Magness |
| 4,109,786 | A | 8/1978 | Roccaforte et al. |
| 4,143,803 | A | 3/1979 | Taylor |
| 4,145,849 | A | 3/1979 | Shindoll et al. |
| 4,176,423 | A | 12/1979 | Wigemark |
| 4,240,240 | A | 12/1980 | Cohen |
| 4,241,832 | A | 12/1980 | Bliss |
| 4,256,043 | A | 3/1981 | Ovitz, III |
| D259,161 | S | 5/1981 | Thauer |
| 4,315,569 | A | 2/1982 | Jaeschke |
| 4,342,268 | A | 8/1982 | Grava |
| 4,378,905 | A | 4/1983 | Roccaforte |
| 4,381,578 | A | 5/1983 | Glejf |
| 4,385,687 | A | 5/1983 | Dutcher |
| 4,388,961 | A | 6/1983 | Schaefer et al. |
| 4,429,791 | A | 2/1984 | Ruppel et al. |
| 4,634,010 | A | 1/1987 | Otema |
| 4,700,918 | A | 10/1987 | Andrasko, Jr. |
| 4,705,175 | A | 11/1987 | Howard et al. |
| 4,720,876 | A | 1/1988 | Tomei et al. |
| 4,750,609 | A | 6/1988 | Felis |
| 4,762,235 | A | 8/1988 | Howard et al. |
| 4,884,687 | A | 12/1989 | Steves |
| 4,899,888 | A | 2/1990 | Shawler |
| 4,909,396 | A | 3/1990 | Younger, Jr. |
| 5,022,104 | A | 6/1991 | Miller |
| 5,031,781 | A | 7/1991 | Price et al. |
| D319,934 | S | 9/1991 | Terrell et al. |
| D323,986 | S | 2/1992 | Ferrero |
| 5,111,943 | A | 5/1992 | Ramey |
| 5,152,689 | A | 10/1992 | Kurzman |
| 5,172,806 | A | 12/1992 | Mickelberg |
| D332,744 | S | 1/1993 | McCooey |
| 5,189,758 | A | 3/1993 | Levy |
| 5,234,113 | A | 8/1993 | Ramey |
| D343,075 | S | 1/1994 | Cappel, III |
| 5,297,685 | A | 3/1994 | Ramey |
| 5,305,898 | A | 4/1994 | Merl |
| D349,458 | S | 8/1994 | Verdaguer |
| 5,346,076 | A | 9/1994 | Hart |
| 5,348,167 | A | 9/1994 | Jensen |
| 5,368,486 | A | 11/1994 | Kurzman |
| 5,372,278 | A | 12/1994 | Leight |
| D355,586 | S | 2/1995 | Wang |
| 5,467,915 | A | 11/1995 | Mattson |
| 5,503,278 | A | 4/1996 | Ishmael |
| 5,509,541 | A | 4/1996 | Merl |
| D372,816 | S | 8/1996 | Rose et al. |
| 5,547,053 | A | 8/1996 | Liang |
| D374,619 | S | 10/1996 | Cook |
| D377,144 | S | 1/1997 | Sawa |
| D383,335 | S | 9/1997 | Shanahan et al. |
| 5,675,936 | A | 10/1997 | Kurth et al. |
| 5,690,157 | A | 11/1997 | Chen |
| D392,820 | S | 3/1998 | Shanahan et al. |
| 5,769,247 | A | 6/1998 | Merl |
| D396,805 | S | 8/1998 | Broyles |
| 5,822,810 | A | 10/1998 | Chen |
| 5,823,339 | A | 10/1998 | Dunham et al. |
| 5,848,446 | A | 12/1998 | DeBraal |
| 5,860,526 | A | 1/1999 | Burke, Jr. |
| D405,369 | S | 2/1999 | Dohner |
| 5,887,782 | A | 3/1999 | Mueller |
| D409,858 | S | 5/1999 | Reed |
| 5,941,384 | A | 8/1999 | Schonhardt et al. |
| D417,978 | S | 12/1999 | Reed |
| D425,972 | S | 5/2000 | Smale |
| 6,102,206 | A | 8/2000 | Pride |
| 6,102,502 | A | 8/2000 | Melillo et al. |
| 6,105,796 | A | 8/2000 | Buchanan et al. |
| 6,170,675 | B1 | 1/2001 | Follman et al. |
| 6,182,738 | B1 | 2/2001 | Chen |
| 6,250,044 | B1 | 6/2001 | Funk et al. |
| 6,286,692 | B1 | 9/2001 | Hemping |

(56) References Cited

U.S. PATENT DOCUMENTS

D451,305 S 12/2001 Chang et al.
D451,801 S 12/2001 Schillinger
6,325,135 B1 12/2001 Lee
6,340,092 B1 1/2002 McGrath, Jr.
D454,067 S 3/2002 Schoening et al.
6,389,991 B1 5/2002 Morrisson
D461,974 S 8/2002 Hayden
6,454,094 B1 9/2002 Salani
6,461,705 B2 10/2002 Eichhorn
6,467,856 B1 10/2002 Chang et al.
6,484,890 B1 11/2002 Miller
D466,804 S 12/2002 Solland
D469,349 S 1/2003 Meeker et al.
D477,217 S 7/2003 Riedi
6,594,973 B1 7/2003 Alpert et al.
D482,265 S 11/2003 Wicha
6,672,546 B2 1/2004 Calleja
6,681,445 B2 1/2004 Huang
6,701,672 B2 3/2004 Teubert et al.
6,811,046 B2 11/2004 Stein
6,840,372 B2 1/2005 Giles et al.
6,850,208 B1 2/2005 Ferrante
6,895,714 B2 5/2005 Teubert et al.
D507,741 S 7/2005 Lu et al.
6,913,151 B2 7/2005 Stevenson
6,935,514 B2 8/2005 Lackey et al.
7,137,172 B2 11/2006 Elmer
7,150,361 B2 12/2006 Calleja
7,178,681 B2 2/2007 Libman
7,264,126 B1 9/2007 Bergeron
7,273,084 B2 9/2007 Chen
7,334,381 B2 2/2008 Mertz, II et al.
7,346,939 B2 3/2008 Perry
D584,528 S 1/2009 Neff et al.
7,481,323 B2 1/2009 Fisher
D588,905 S 3/2009 Meeks et al.
7,513,636 B2 4/2009 Beasley
7,523,598 B1 4/2009 Eckert
D593,409 S 6/2009 Blick
D594,742 S 6/2009 Meier et al.
7,562,949 B1 7/2009 Nielsen
D600,110 S 9/2009 Cain
7,637,059 B2 12/2009 Chang et al.
D607,724 S 1/2010 Dreier et al.
D616,742 S 6/2010 Lymn et al.
7,748,527 B2 7/2010 Wisecarver et al.
7,762,508 B2 7/2010 Xu
D622,083 S 8/2010 Linder
D625,179 S 10/2010 Gibson
7,828,151 B2 11/2010 Murdoch et al.
7,841,048 B2 11/2010 Tsai
7,854,096 B2 12/2010 Brisbois et al.
7,900,784 B1 3/2011 Weigand et al.
D639,652 S 6/2011 Abdalkhani et al.
7,962,998 B2 6/2011 Proctor et al.
7,980,453 B2 7/2011 Hall
7,987,654 B1 8/2011 Eckert
D652,717 S 1/2012 Shimoyama et al.
8,136,202 B2 3/2012 Hanley
8,151,385 B2 4/2012 Goskowski et al.
D660,988 S 5/2012 Amend
8,191,707 B2 6/2012 McDonald et al.
D668,158 S 10/2012 Gridley
D668,540 S 10/2012 Lutzig
D671,401 S 11/2012 Grabes et al.
8,312,998 B2 11/2012 Theisen
D671,829 S 12/2012 Sung
D685,260 S 7/2013 Thielemier
8,490,331 B2 7/2013 Quesada
D689,360 S 9/2013 Adams
D690,592 S 10/2013 Ding
D690,593 S 10/2013 Kaps et al.
D693,218 S 11/2013 Sill
D694,099 S 11/2013 Ensslen, III et al.
D699,103 S 2/2014 Rathbone et al.
D699,563 S 2/2014 McAdam
D700,713 S 3/2014 Williams, III
8,707,475 B2 4/2014 Johnson et al.
8,720,684 B2 5/2014 Balmer et al.
D706,129 S 6/2014 Boraczek et al.
D706,626 S 6/2014 Lazar
D709,363 S 7/2014 Boehnen et al.
8,789,899 B2 7/2014 Pirro et al.
D710,713 S 8/2014 Fath
8,915,381 B2 12/2014 Brozak et al.
D725,480 S 3/2015 Lipman et al.
D729,055 S 5/2015 Lemnios et al.
9,108,775 B2 8/2015 Savakus
D739,726 S 9/2015 Lemnios et al.
D742,739 S 11/2015 Kim et al.
D746,672 S 1/2016 McNamee
9,340,373 B2 5/2016 Mchugh et al.
D758,771 S 6/2016 Austin, III et al.
D759,407 S 6/2016 Denby
D763,023 S 8/2016 Austin, III et al.
D767,380 S 9/2016 Austin, III et al.
9,434,524 B2 9/2016 Kindig
D777,018 S 1/2017 Boehnen et al.
D777,564 S 1/2017 Boehnen et al.
9,676,543 B2 6/2017 Lemnios et al.
D791,519 S 7/2017 Jordan et al.
9,737,175 B2 8/2017 Wei
9,743,810 B2 8/2017 Schultz et al.
9,907,415 B2 3/2018 Boehnen et al.
10,984,688 B2 4/2021 Cantwell et al.
11,439,255 B2 9/2022 Austin, III et al.
2001/0002660 A1 6/2001 Riga et al.
2001/0054258 A1 12/2001 Becken
2002/0134030 A1 9/2002 Conway
2002/0144375 A1 10/2002 Drucker et al.
2002/0157318 A1 10/2002 Teubert et al.
2003/0019982 A1 1/2003 Wing et al.
2003/0047528 A1 3/2003 Stein
2004/0159049 A1 8/2004 Teubert et al.
2004/0177437 A1 9/2004 Perry
2004/0238465 A1 12/2004 Mercure
2004/0245195 A1 12/2004 Pride
2005/0006332 A1 1/2005 Stein
2005/0115202 A1 6/2005 Mertz, II et al.
2005/0115860 A1 6/2005 Mertz, II et al.
2005/0236299 A1 10/2005 Weber et al.
2006/0043032 A1 3/2006 McHugh
2006/0169609 A1 8/2006 Sanders, Jr.
2006/0196838 A1 9/2006 Mercure et al.
2006/0208150 A1 9/2006 Elmer et al.
2007/0045204 A1 3/2007 Huard et al.
2007/0295680 A1 12/2007 Budge et al.
2008/0072499 A1 3/2008 Sibbett
2008/0073469 A1 3/2008 Mushan et al.
2008/0148639 A1 6/2008 Jakob-Bamberg et al.
2008/0148692 A1 6/2008 Wisecarver et al.
2008/0277363 A1 11/2008 McDonough
2009/0115299 A1 5/2009 Ricereto
2009/0250416 A1 10/2009 Chookang
2009/0320344 A1* 12/2009 Barkdoll ..... G09F 3/204
40/661.03
2010/0107497 A1 5/2010 Hulst et al.
2010/0181267 A1 7/2010 Theisen
2010/0264058 A1 10/2010 Krause
2011/0035871 A1 2/2011 Seymour et al.
2011/0094162 A1 4/2011 Morris et al.
2011/0113547 A1 5/2011 O'Connell
2012/0005822 A1 1/2012 Daubmann et al.
2012/0036628 A1 2/2012 O'Connell
2012/0175330 A1 7/2012 Nicholls et al.
2012/0187012 A1 7/2012 TeVault et al.
2012/0233926 A1 9/2012 Chang et al.
2012/0259743 A1 10/2012 Pate, Jr.
2013/0093298 A1 4/2013 Ehmke et al.
2013/0140319 A1 6/2013 Tam et al.
2013/0161276 A1 6/2013 Breeden et al.
2013/0199954 A1 8/2013 Huard et al.
2013/0325670 A1 12/2013 Austin, III et al.
2014/0032447 A1 1/2014 Fisher

(56) References Cited

U.S. PATENT DOCUMENTS

| | | | |
|---|---|---|---|
| 2014/0173990 | A1 | 6/2014 | Schachter et al. |
| 2014/0237715 | A1 | 8/2014 | Wei |
| 2014/0250795 | A1 | 9/2014 | Wei |
| 2014/0259363 | A1 | 9/2014 | Ball et al. |
| 2014/0290001 | A1 | 10/2014 | Hasegawa |
| 2014/0319988 | A1 | 10/2014 | Dietz et al. |
| 2014/0331564 | A1 | 11/2014 | Wei |
| 2014/0332431 | A1 | 11/2014 | Naeyaert et al. |
| 2015/0096117 | A1 | 4/2015 | Forrest et al. |
| 2015/0210113 | A1 | 7/2015 | Yang |
| 2022/0133062 | A1 | 5/2022 | Osiecki et al. |

FOREIGN PATENT DOCUMENTS

| | | | |
|---|---|---|---|
| CN | 203175303 | U | 9/2013 |
| CN | 204326804 | U | 5/2015 |
| CN | 204370961 | U | 6/2015 |
| DE | 2149016 | | 4/1973 |
| DE | 9306878 | | 8/1993 |
| DE | 202009004111 | U1 | 8/2009 |
| EP | 0015827 | A1 | 9/1980 |
| EP | 0600506 | A2 | 6/1994 |
| EP | 0729902 | A1 | 9/1996 |
| EP | 1020154 | A2 | 7/2000 |
| EP | 1623656 | A1 | 2/2006 |
| EP | 2317052 | A2 | 5/2011 |
| EP | 2774519 | A1 | 9/2014 |
| EP | 2982273 | A1 | 2/2016 |
| GB | 827312 | | 2/1960 |
| JP | H05178372 | A | 7/1993 |
| JP | 2001095657 | A | 4/2001 |
| JP | 2003237846 | A | 8/2003 |
| SE | 511885 | C2 | 12/1999 |
| WO | 2005035396 | A2 | 4/2005 |
| WO | 2005035396 | A3 | 4/2005 |
| WO | 2008076224 | A1 | 6/2008 |
| WO | 2008133531 | A1 | 11/2008 |
| WO | 2009029358 | A1 | 3/2009 |
| WO | 2010014659 | A1 | 2/2010 |
| WO | 2010108004 | A1 | 9/2010 |

OTHER PUBLICATIONS

CRL, "Installation Instructions CRL Deluxe Serenity Series SER78 Sliding Door Kit", Dec. 13, 2019, 11 pages.
CRL Architectural, "The CRL Serenity Sliding Shower Door System", Dec. 15, 2011, 1 page.
CRL, "Installation Instructions Senior Serenity Series SRSER78 Sliding Door Kit", Feb. 17, 2020, 12 pages.
MAAX Bath Inc., Halo Shower Door, Jun. 13, 2013, 1 page.
Kohler, "Installation Instructions Sliding Shower and Bath Doors", 2020, 76 pages.
The Bold Look of Kohler, Installation and Care Instructions Sliding Bath and Shower Doors, 2015, 6 pages.
Kohler, "Installation and Care Guide Sliding Shower and Bath Doors", 2016, 104 pages.
Kohler, "Easy to Clean, Frameless Glass Shower Doors—Explore Kohler Levity", Mar. 18, 2014, 1 page.
Mexico Office Action for Application No. MX/f/2007/000128, dated Jan. 17, 2007, 17 pages.
Third-Party Information Liability Disclaimer for Canadian Application No. 139692, May 27, 2011, 8 pages, CW001390-CW001397.
Third-Party Information Liability Disclaimer for Canadian Application No. 139692, May 27, 2011, 8 pages, CW001431-CW001438.
Vivez l'experience MAAX, Installation Instructions, Jun. 29, 2020, 24 pages.
Vivez l'experience MAAX, Installation Instructions, Aug. 30, 2022, 28 pages.
Xbox Packaging, en.wikipedia.org > wiki > Xbox, Nov. 22, 2013, 1 page.
Dyson DC41 Unboxing and first look, youtube.com/watch?v=HMedYKOE-pl&t=3s, Apr. 25, 2012, 2 pages.
Halo Shower Door—MAAX Bath Inc., youtube.com/watch?v=EAj8vRivxM, Jun. 13, 2013, 1 page.
Easy to Clean, Frameless Glass Shower Doors—Explore Kohler Levity, youtube.com/watch?v=BKGrnt8D18, Mar. 18, 2014, 1 page.
The CRL Serenity Sliding Shower Door System, youtube.com/watch?v=yhSJiuNSRbA, Dec. 15, 2011, 1 page.
Sterling, A Kohler Company, "Installation Guide, Bypass Shower Doors", SP5900 Series, 2004, 16 pages.
Canadian Office Action for Application No. 2,860,371, dated Oct. 23, 2020, 4 pages.
European Extended Search Report for Application No. 15152840.3, dated Nov. 9, 2015, 11 pages.
European Search Report for Application No. 15152840.3, dated Jun. 30, 2015, 6 pages.
http://www.johnsonhardware.com/doordisplay.htm, "Johnson Hardware Door Panel Display Unit", Dec. 16, 2010, 2 pages.
Mexican Office Action for Application No. MX/a/2014/013774, dated Apr. 21, 2017, 3 pages.
Mexican Office Action for Application No. MX/a/2014/013774, dated Aug. 15, 2017, 4 pages.
Mexican Office Action for Application No. MX/a/2014/013774, dated Jan. 18, 2018, 4 pages.
Quality Craft, "Installation Manual Shower Unit", Model No. 961WUX006WHI, Mar. 9, 2011, 14 pages.
www.thermatru.com/trade-professional/dpprgallerdisplays.aspx, "Door Gallery Displays", Jul. 10, 2010, 31 pages.
HouseImprovements, Video: "How To Install Glass Sliding Shower Doors," Oct. 4, 2012, https://www.youtube.com/watch?v-u88j284_jAk, 32:25.
Canadian Office Action for Application No. 2,860,371, dated Dec. 23, 2021, 3 pages.

* cited by examiner

SHOWER DOOR ASSEMBLY DISPLAY

CROSS-REFERENCE TO RELATED APPLICATIONS

This application is a continuation of U.S. application Ser. No. 17/344,050 filed Jun. 10, 2021, now U.S. Pat. No. 12,144,441 B2, which is a division of U.S. application Ser. No. 16/058,244 filed Aug. 8, 2018, now U.S. Pat. No. 11,058,237 B2, which is a division of U.S. application Ser. No. 14/167,230 filed Jan. 29, 2014, now U.S. Pat. No. 10,070,739 B2, the disclosures of which are hereby incorporated in their entirety by reference herein.

U.S. application Ser. No. 17/344,050 filed Jun. 10, 2021, now U.S. Pat. No. 12,144,441 B2, is also a division of U.S. application Ser. No. 15/950,400 filed Apr. 11, 2018, now U.S. Pat. No. 11,089,887 B2, which is a continuation of U.S. application Ser. No. 14/167,230 filed Jan. 29, 2014, now U.S. Pat. No. 10,070,739 B2, the disclosures of which are hereby incorporated in their entirety by reference herein.

TECHNICAL FIELD

Various embodiments relate to shower door assemblies; retail displays for displaying shower door assemblies; methods for manufacturing shower door components; and methods for installing shower door assemblies.

BACKGROUND

The prior art has provided shower door assemblies that are assembled and packaged for retail.

SUMMARY

According to at least one embodiment, a retail shower door display assembly is provided with a point-of-sale display unit sized to be received within a retail store aisle. A first array of shower door glass panes is oriented within the display unit. Each shower door glass pane of the first array has a height, a thickness and a width. A second array of shower door glass panes is oriented within the display unit. Each shower door glass pane of the second array has a height, a thickness and a width that is different than the width of the first array of shower door glass panes. An array of shower door tracks is oriented within the display unit. Each shower door track of the array has a common length.

According to at least one embodiment, a method of installing a shower door assembly provides at least one shower door track from an array of shower door tracks oriented within a point-of-sale display unit sized to be received within a retail store aisle of a retail shower display assembly, wherein each shower door track of the array has a common length. The at least one shower door track is installed. At least one shower door glass pane is provided from one of a first array of shower door glass panes oriented within the display unit, and a second array of shower door glass panes oriented within the display unit. Each shower door glass pane of the first array has a height, a thickness and a width. Each shower door glass pane of the second array has a height, a thickness and a width that is different than the width of the first array of shower door glass panes. The at least one shower door glass pane is installed to the at least one shower door track.

According to at least another embodiment, a retail shower door display assembly is provided with a point-of-sale display unit sized to be received within a retail store aisle.

A first array of shower door glass panes is oriented within the display unit. Each shower door glass pane of the first array has a height, a thickness and a width. A second array of shower door glass panes is oriented within the display unit. Each shower door glass pane of the second array has a height, a thickness and a width, at least one of the height and the width is different than that of the first array of shower door glass panes. An array of towel bars is oriented within the display unit. Each towel bar of the array has a common length.

According to at least another embodiment, a method of installing a shower door assembly provides at least one shower door glass pane from one of a first array of shower door glass panes and a second array of shower door glass panes oriented within a point-of-sale display unit sized to be received within a retail store aisle of a retail shower door display assembly. Each shower door glass pane of the first array has a height, a thickness and a width. Each shower door glass pane of the second array has a height, a thickness and a width that is different than the width of the first array of shower door glass panes. At least one towel bar is provided from an array of towel bars oriented within the display unit. Each towel bar of the array has a common length. The at least one towel bar is installed to the at least one shower door glass pane.

According to at least one embodiment, a method of manufacturing shower door components is provided by forming a first plurality of shower door glass panes, each with a height, a thickness and a width. An aperture pattern is formed in each of the first plurality of shower door glass panes to mount a towel bar to the aperture pattern. Each of the first plurality of shower door glass panes is tempered after the aperture pattern is formed. A second plurality of shower door glass panes is provided, each with a height, a thickness and a width that is different than the width of the first plurality of shower door glass panes. An aperture pattern is formed in each of the second plurality of shower door glass panes, common to the aperture pattern formed in the first plurality of shower door glass panes, to mount a towel bar to the aperture pattern. Each of the second plurality of shower door glass panes is tempered after the aperture pattern is formed. A plurality of towel bars is provided, having a common mounting pattern to mount to the aperture pattern in the first plurality of shower door glass panes and the second plurality of shower door glass panes.

According to an embodiment, a shower door assembly is manufactured according to a method of manufacturing shower door components by forming a first plurality of shower door glass panes, each with a height, a thickness and a width. An aperture pattern is formed in each of the first plurality of shower door glass panes to mount a towel bar to the aperture pattern. Each of the first plurality of shower door glass panes is tempered after the aperture pattern is formed. A second plurality of shower door glass panes is provided, each with a height, a thickness and a width that is different than the width of the first plurality of shower door glass panes. An aperture pattern is formed in each of the second plurality of shower door glass panes, common to the aperture pattern formed in the first plurality of shower door glass panes, to mount a towel bar to the aperture pattern. Each of the second plurality of shower door glass panes is tempered after the aperture pattern is formed. A plurality of towel bars is provided, having a common mounting pattern to mount to the aperture pattern in the first plurality of shower door glass panes and the second plurality of shower door glass panes.

According to another embodiment, a shower door assembly is manufactured according to a method of manufacturing shower door components by forming a first plurality of shower door glass panes, each with a height, a thickness and a width. An aperture pattern is formed in each of the first plurality of shower door glass panes to mount a towel bar to the aperture pattern. Each of the first plurality of shower door glass panes is tempered after the aperture pattern is formed. A second plurality of shower door glass panes is provided, each with a height, a thickness and a width that is different than the width of the first plurality of shower door glass panes. An aperture pattern is formed in each of the second plurality of shower door glass panes, common to the aperture pattern formed in the first plurality of shower door glass panes, to mount a towel bar to the aperture pattern. Each of the second plurality of shower door glass panes is tempered after the aperture pattern is formed. A plurality of towel bars is provided, having a common mounting pattern to mount to the aperture pattern in the first plurality of shower door glass panes and the second plurality of shower door glass panes. A plurality of shower door tracks are formed each having a common length.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Conventional shower door assemblies are typically retailed pre-bundled or prepackaged. Conventional shower door assemblies typically include shower door glass panes, shower door tracks, and shower hardware assemblies. The preassembled retail of these assemblies limits consumer options, while providing an overall unit that is relatively large and consequently difficult to transport from the point-of-sale to the point of installation. The preassembled unit may also be difficult to install.

Conventional shower door assemblies are often provided in varying sizes and styles. Therefore, for each style, shower door glass panes, shower door tracks, and towel bars are often provided specific to each standard sized for the shower door assemblies. All of the components required for the varying sizes and styles results in a large number of components to manufacture and retail.

Figure 1:
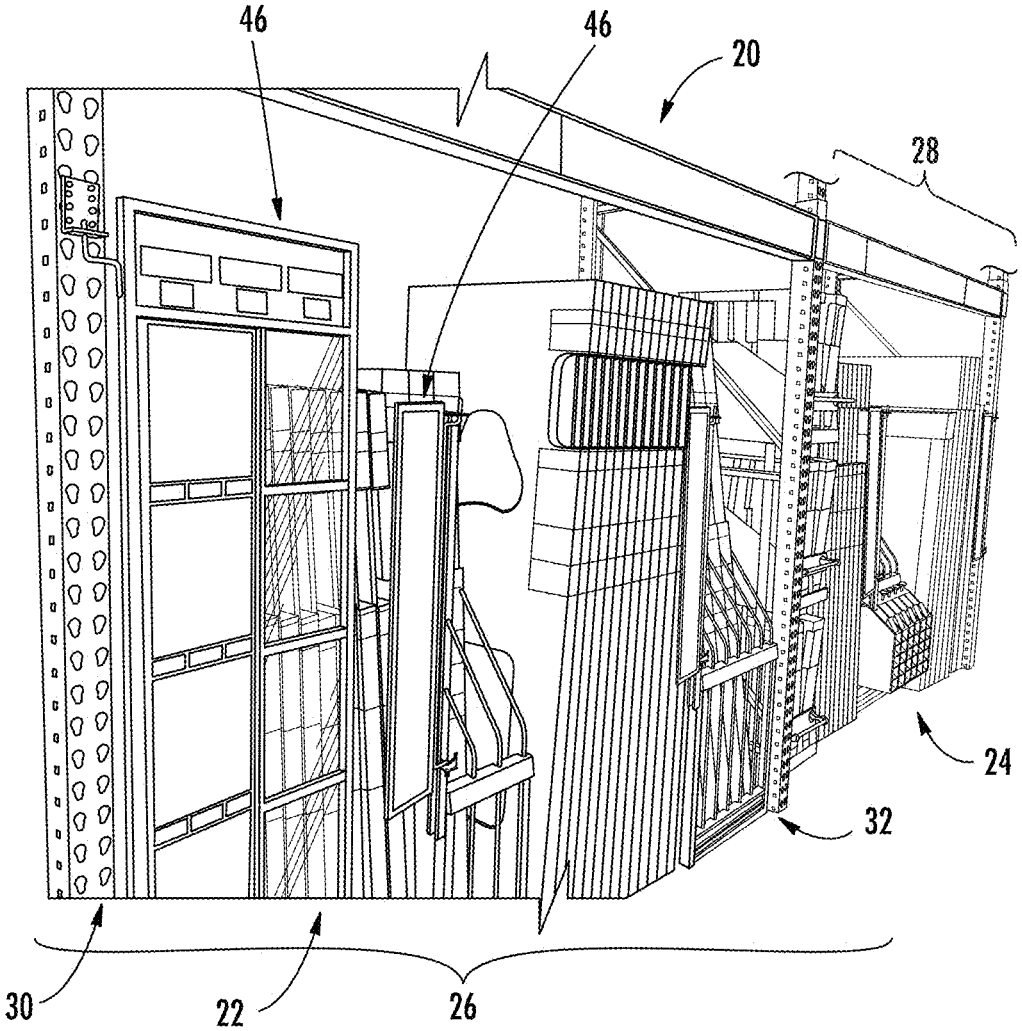
FIG. 1 is a perspective view of retail shower door display system according to an embodiment.
Figure 2:
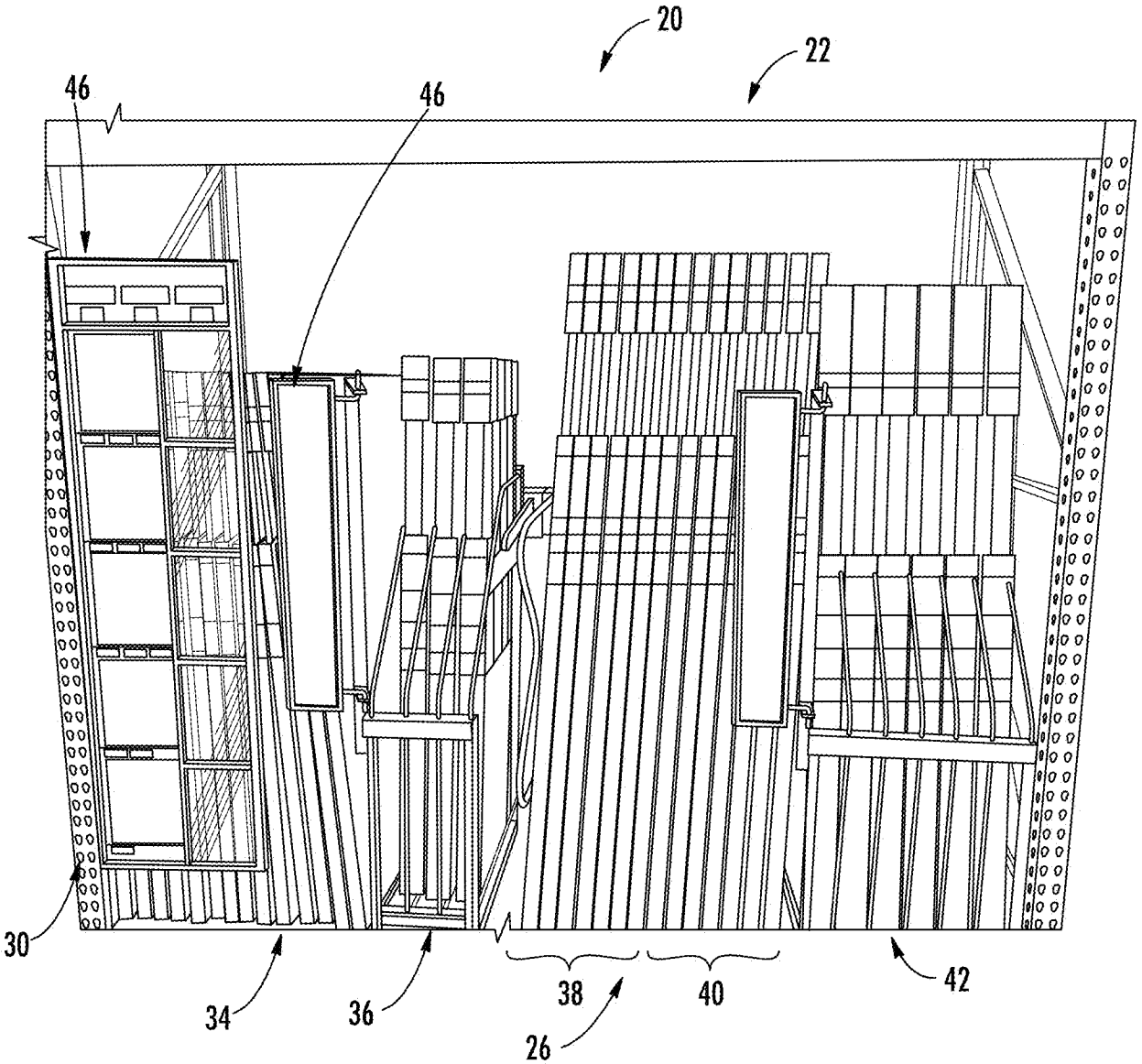
FIG. 2 is a front perspective view of a retail shower door display assembly of FIG. 1.
Figure 3:
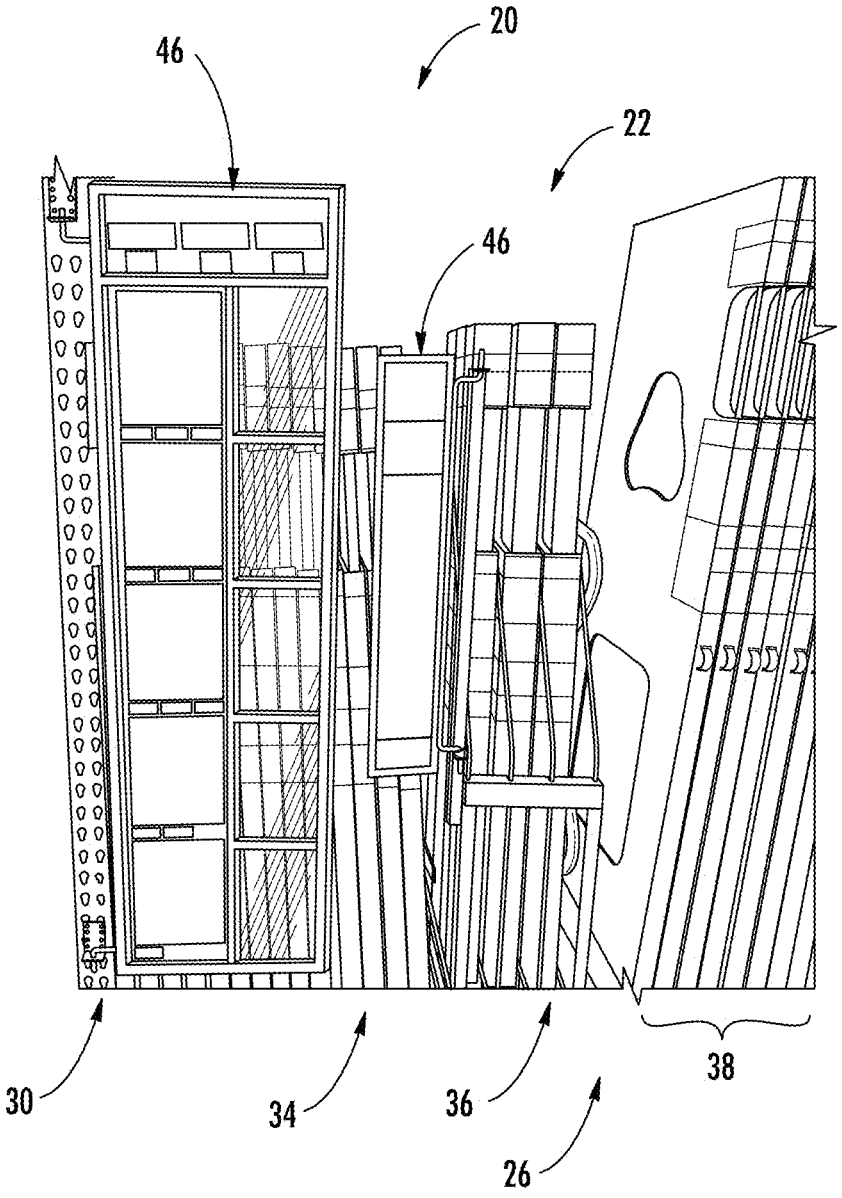
FIG. 3 is an enlarged front perspective view of signage of the retail shower door display assembly of FIG. 2.
Figure 4:
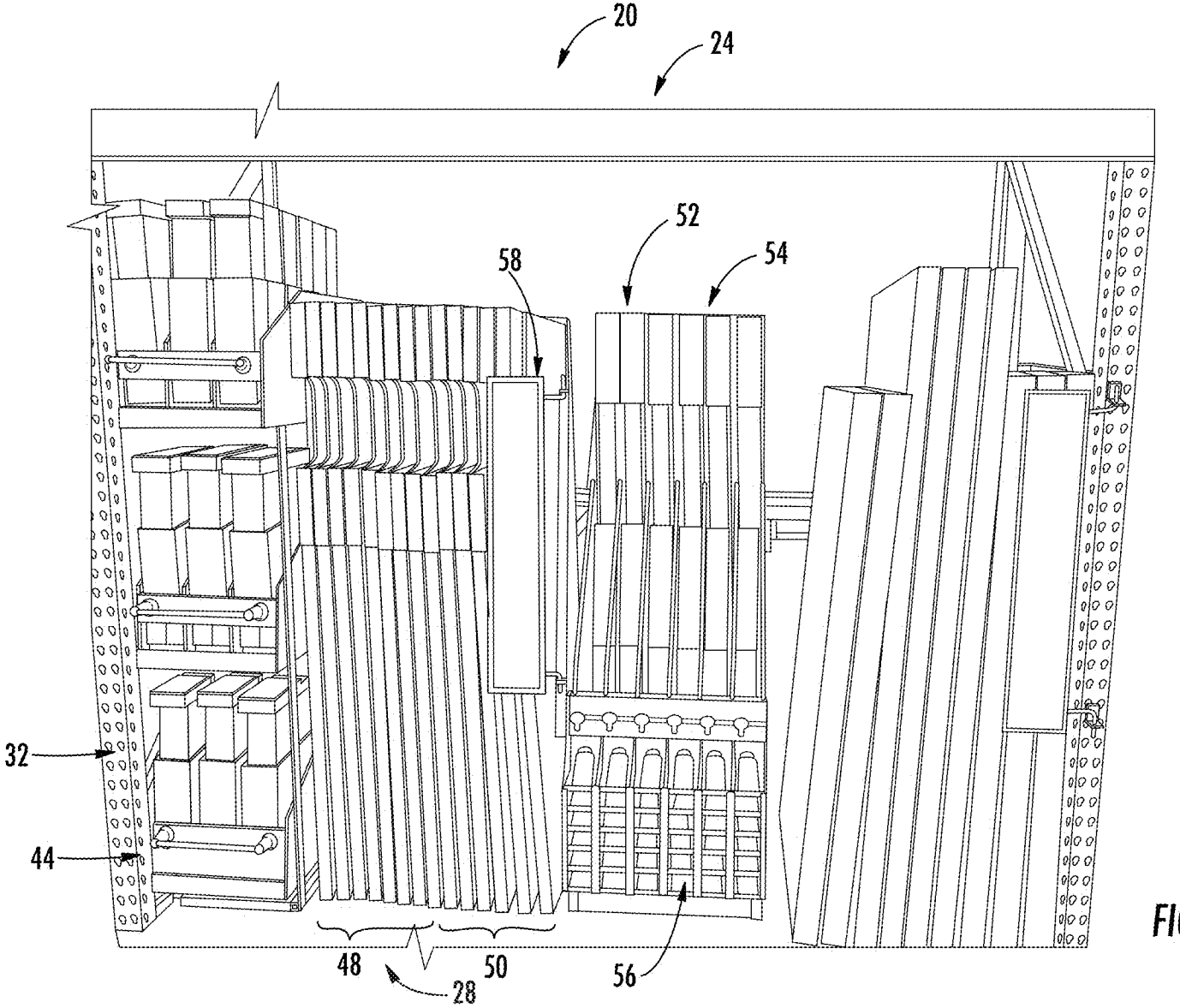
FIG. 4 is a front perspective view of another retail shower door display assembly of FIG. 1.

Referring now to FIG. 1, a retail shower door display system is illustrated according to an embodiment, and referenced generally by numeral 20. The display system 20 is provided by, for example, a pair of retail shower door display assemblies 22, 24. The display system 20 is sized to be displayed within a retail store aisle, such as a home improvement store. The display system 20 is utilized for both displaying and retailing shower door components.

Shower door assemblies are conventionally categorized by function or type. For example, shower door assemblies include sliding shower door assemblies 26 and pivoting shower door assemblies 28. The first decision a consumer of shower door assemblies may need to decide is which style or category 26, 28 of shower door assembly is desired. Once the consumer selects a category 26, 28, the consumer may approach the corresponding display assembly 22, 24.

The retail shower door display system 20 includes a pair of point-of-sale display units 30, 32. Of course, any number of point-of-sale display units is contemplated; and as will be explained, it is advantageous to provide the greatest variety of products per each point-of-sale display unit 30, 32. The point-of-display units 30, 32 are sized to be received within a retail store aisle; and may be sized the same as conventional shelving for preassembled doors for easy replacement.

The sliding shower door assembly 26 includes an array of shower door glass panes 34, which may be for sliding tub doors, for example. The shower door glass panes 34 may vary in style. The shower door glass panes 34 each have a standard height, a standard thickness, and a standard width for that application. An array of shower door tracks 36 is provided in the display unit 30 with standard dimensions for the sliding tub door application. The tracks 36 may also vary in style. The separate packaging permits the customer to select from a large combination of varieties due to the interchangeability of the glass panes 34 and the tracks 36. The tracks 36 depicted are guide tracks 36 for sliding a pair of shower door glass panes 34 within the guide tracks 36. Alternatively to, or in addition to, the tracks 36 may be frames for the shower door glass panes 34.

The sliding shower door assemblies 26 also include an array of shower door glass panes 38 for sliding shower doors. The shower door glass panes 38 include a standard height, which is typically greater than that for a sliding tub door. The shower door glass panes 38 have a standard thickness, and a standard width, for example, to span up to a forty-eight inch shower door opening. Another array of shower door glass panes 40 is provided similar to the shower door glass panes 38, except, the second array of sliding shower doors glass panes 40 have a greater standard width, such as to span up to a sixty inch shower door opening.

The sliding shower door assemblies 26 include an array of shower door tracks 42 for a sliding shower doors, which according to one embodiment all have a common length only, for example the greater of the standard shower door opening size of sixty inches. According to another embodiment, the array may include sets of tracks 42 in a first length, such as forty-eight inches and sets of tracks 42 in a second length, such as sixty inches. The array of shower door tracks 42 may include shower door tracks in various finishes, such as chrome, nickel and bronze. No other tracks are provided for sliding shower doors to minimize space occupied in the display unit 30. A customer requiring a shorter track purchases one of the tracks 42; and shortens the track 42 prior to installation. By providing only one track size for different size shower door glass panes 38, 40 manufacturing costs are lowered, providing a cost-savings to the end customer, while reducing space required in the display unit 30.

Next, an array of towel bars 44 is oriented within the display unit 32. Each towel bar 44 of the array has a common length. Additionally, each towel bar 44 has a common mounting pattern. Likewise, each of the shower door glass panes 34, 38, 40 each have a common aperture pattern that corresponds to the common mounting pattern of the towel bars 44. By providing one standardized towel bar 44 size, various combinations with each of the shower door glass panes 34, 38, 40 can be achieved while providing a vast reduction to shelf space. In order to meet this end, the aperture patterns are formed in the glass panes 34, 38, 40 prior to tempering. By standardizing the aperture patterns, manufacturing costs are also minimized.

The retail shower door display system 20 also includes signage 46 for explaining the sequence for a customer to select the components for a shower door assembly 26, 28. The signage 46 is movably attached to an opening of the display system 20, at hardware that defines the opening. The glass panes 34, 38, 40 are provided sequentially prior to the tracks 36, 42 because customers typically select the glass panes 34, 38, 40 first since it is the largest aesthetic and functional component of the assembly 26, 28.

The display unit 32 also includes a pair of arrays of shower door glass panes 48, 50 for pivoting shower door assemblies 28 in two standard sizes, such as thirty-one inches and thirty-six inches by way of example. A pair of arrays of shower tracks 52, 54 for the pivoting shower door assemblies 28 are also provided in the two standard sizes. An array of pull handles 56 is provided for use with the various shower door glass panes 48, 50. Signage 58 is provided to explain the sequence for selecting components.

The retail shower door display system 20 provides a large variation of shower door assemblies 26, 28 without limits provided in prepackaged assemblies. Interchangeability of tracks 36, 42, 52, 54, towel bars 44 and pull handles 56 further saves shelf space. The pull handles 56 are provided in multiple finishes, such as chrome, nickel and bronze, and are sized to be mounted to either size glass pane 48, 50. In the depicted embodiment, 183 combinations are provided in less than two display units 30, 32, which if prepackaged as in the prior art, would require almost eight display units.

The retail shower door display system 20 allows the consumer to custom configure a shower door based on the consumer's selection. The retail shower door display system 20 enables the consumer to mix and match style, finish, and glass textures for a customized sliding-tub shower door assembly 26, sliding shower door assembly 26 or a pivot shower door assembly 28. The retail shower door display system 20 permits the manufacture to retail more Stock Keeping Units (SKUs) in the retail shower door display system 20 than would be practical with traditional preassembled and prepackaged shower door assemblies. The consumer can avoid having to lift, carry and transport a single total weight package due to the separation of the components. Consumers can also more readily transport components in vehicles due to an ability to place each packaged component in a vehicle interior and trunk due to separate packaging. Also, the customer can purchase replacement parts without a need to replace an entire shower door assembly in case of component repair when a specific component requires replacement, but the entire assembly does not require replacement. The customer can purchase replacement parts for new remodeling efforts where a glass or frame finish change is desired. The customer can purchase replacement parts for future product maintenance when one or more components require replacement due to wear or damage.

The manufacturer can also avoid steps of shipping the components to a common facility for assembling and packaging. The manufacturer can also more readily maintain inventory; easily add new products to the retail shower door display system 20; and regionalize the product mix.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A shower door retail comprising:

a first array of separately packaged shower door glass panes, each shower door glass pane of the first array having a height, a thickness, and a width;

a second array of separately packaged shower door glass panes, each shower door glass pane of the second array having a height, a thickness, and a width that is different than the width of the first array of shower door glass panes; and an array of towel bars, each towel bar of the array having a common mounting pattern; and wherein the array of towel bars is packaged separately from the first array of separately packaged shower door glass panes, and from the second array of separately packaged shower door panes.

2. The shower door retail of claim 1, wherein the first array has the height, the thickness, and the width for a first shower door opening;

wherein each shower door glass pane of the second array has the height, the thickness, and the width for a second shower door opening; and wherein the shower door retail further comprises an array of shower door tracks, each shower door track of the array sized for a shower door opening that is a larger of the first shower door opening and the second shower door opening, wherein each shower door track of the array of shower door tracks is packaged separately from the first array of separately packaged shower door glass panes, and wherein each shower door track of the array of shower door tracks is packaged separately from the second array of separately packaged shower door glass panes.

3. The shower door retail of claim 2, wherein the width of the second array of shower door glass panes is greater than the width of the first array of shower door glass panes;

wherein each shower door track of the array of shower door tracks is sized for the second shower door opening; and wherein the array of shower door tracks is adapted to be shortened to correspond to the first shower door opening.

4. The shower door retail of claim 3, wherein the first array of shower door glass panes is sized to span a forty-eight inch shower door opening.

5. The shower door retail of claim 3, wherein the second array of shower door glass panes is sized to span a sixty inch shower door opening.

6. The shower door retail of claim 2, wherein a length of each of the array of shower door tracks is greater than forty-eight inches.

7. The shower door retail of claim 2, wherein a length of each of the array of shower door tracks is sized for a sixty inch shower door opening.

8. The shower door retail of claim 2, wherein the array of towel bars is packaged separately from the array of shower door tracks.

9. The shower door retail of claim 8, wherein the first and second arrays of shower door glass panes, the array of shower door tracks, and the array of towel bars are oriented sequentially for user selection of a shower door glass pane first, a shower door track second, and subsequently a towel bar.

10. The shower door retail of claim 9, further comprising signage to explain a sequence for a customer to select components.

11. The shower door retail of claim 1, wherein an aperture pattern is formed in each of the first array of shower door glass panes to mount a towel bar to the aperture pattern.

12. The shower door retail of claim 11, wherein an aperture pattern is formed in each of the second array of shower door glass panes to mount a towel bar to the aperture pattern.

13. A shower door retail comprising:

a first array of shower door glass panes, each shower door glass pane of the first array having a height, a thickness, and a width for a first shower door opening;

a second array of shower door glass panes, each shower door glass pane of the second array having a height, a thickness, and a width for a second shower door opening that is different than the width of the first array of shower door glass panes; and an array of shower door tracks, each shower door track of the array sized for a shower door opening that is a larger of the first shower door opening and the second shower door opening, wherein each shower door track of the array of shower door tracks is packaged separately from the first array of shower door glass panes, and wherein each shower door track of the array of shower door tracks is packaged separately from the second array of shower door glass panes;

wherein the shower door glass panes of the first array are separately packaged from the shower door glass panes of the second array; and wherein the shower door glass panes of the second array are separately packaged from the shower door glass panes of the first array.

14. A shower door retail comprising:

a first array of separately packaged shower door glass panes, each shower door glass pane of the first array having a height, a thickness, and a width;

a second array of separately packaged shower door glass panes, each shower door glass pane of the second array having a height, a thickness, and a width that is different than the width of the first array of shower door glass panes;

an array of towel bars, each towel bar of the array having a common mounting pattern;

wherein the first array has the height, the thickness, and the width for a first shower door opening;

wherein each shower door glass pane of the second array has the height, the thickness, and the width for a second shower door opening; and an array of shower door tracks, each shower door track of the array sized for a shower door opening that is a larger of the first shower door opening and the second shower door opening, wherein each shower door track of the array of shower door tracks is packaged separately from the first array of separately packaged shower door glass panes, and wherein each shower door track of the array of shower door tracks is packaged separately from the second array of separately packaged shower door glass panes.

15. A shower door retail comprising:

a first array of separately packaged shower door glass panes, each shower door glass pane of the first array having a height, a thickness, and a width;

a second array of separately packaged shower door glass panes, each shower door glass pane of the second array having a height, a thickness, and a width that is different than the width of the first array of shower door glass panes; and an array of towel bars, each towel bar of the array having a common mounting pattern; and wherein an aperture pattern is formed in each of the first array of shower door glass panes to mount a towel bar to the aperture pattern.

* * * * *